US007142639B2

(12) United States Patent
Smith et al.

(10) Patent No.: US 7,142,639 B2
(45) Date of Patent: Nov. 28, 2006

(54) HIGH VOLTAGE CONNECTOR FOR X-RAY TUBE

(75) Inventors: David Craig Smith, Herriman, UT (US); Mike Vanvoorhis, South Jordan, UT (US); Christopher Artig, Summit Park, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 45 days.

(21) Appl. No.: 10/827,153

(22) Filed: Apr. 19, 2004

(65) Prior Publication Data

US 2005/0232395 A1 Oct. 20, 2005

(51) Int. Cl.
*H01J 35/00* (2006.01)

(52) U.S. Cl. ..... 378/121; 378/204; 439/611

(58) Field of Classification Search ..... 378/101, 378/117, 121, 119, 204; 439/199, 278, 279, 439/280, 281, 282, 367, 588, 611
See application file for complete search history.

(56) References Cited

U.S. PATENT DOCUMENTS

| | | | | |
|---|---|---|---|---|
| 3,555,487 A * | 1/1971 | Jones | 439/282 |
| 4,412,938 A | 11/1983 | Kakizaki et al. | 252/511 |
| 4,618,977 A | 10/1986 | Brettschneider et al. | 378/139 |
| 4,685,118 A | 8/1987 | Furbee et al. | 378/114 |
| 4,738,798 A | 4/1988 | Mahler | 252/62.3 Q |
| 4,774,137 A | 9/1988 | Alberts et al. | 428/407 |
| 5,238,607 A | 8/1993 | Herron et al. | 252/519.34 |
| 5,340,500 A | 8/1994 | Chao et al. | 252/500 |
| 5,515,413 A | 5/1996 | Knudsen et al. | 378/136 |
| 5,556,716 A | 9/1996 | Herron et al. | 428/688 |
| 5,866,252 A | 2/1999 | de Rochemont et al. | 428/373 |
| 6,148,061 A | 11/2000 | Shefer et al. | 378/121 |
| 6,195,411 B1 | 2/2001 | Dinsmore | 378/65 |
| 6,556,654 B1 * | 4/2003 | Hansen et al. | 378/101 |

OTHER PUBLICATIONS

Article Entitled "*Multilayer High Gradient Insulator Technology*;" IEEE Transactions on Dielectrics and Electrical Insulation, vol. 7, No. 3, Jun. 2000, pp. 334-339; by S.E. Sampayan, P.A. Vitello, M. L. Krogh and J. M. Elizondo.

* cited by examiner

*Primary Examiner*—Courtney Thomas
(74) *Attorney, Agent, or Firm*—Workman Nydegger

(57) ABSTRACT

A dielectric connector for use in high voltage devices, including x-ray tubes, is disclosed. The connector comprises a dielectric material and is pre-formed before attachment to the x-ray tube. Pre-formation of the connector creates a first cavity portion therein that conforms in shape to a corresponding segment of the tube surface. A second cavity portion is also defined for receiving a high voltage receptacle. Upon attachment to the tube, the first cavity portion receives the corresponding tube segment. The high voltage receptacle is received into the second cavity portion and electrically connects with a receptacle defined on the tube surface. The receptacle enables a high voltage signal passing through the electrode to connect with either the anode or cathode disposed within the tube. Pre-formation of the connector enables connector testing and repair to occur before it is attached to the tube, saving resources, time, and cost.

39 Claims, 7 Drawing Sheets

HIGH VOLTAGE CONNECTOR FOR X-RAY TUBE

BACKGROUND

1. The Field of the Invention

The present invention generally relates to high voltage devices, such as x-ray tubes. In particular, embodiments of the present invention relate to improvements for providing high voltage electrical connections within an x-ray tube environment.

2. The Related Technology

X-ray generating devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

In a typical x-ray device, x-rays are produced when electrons are emitted, accelerated, and then impinged upon a material of a particular composition. This process typically takes place within an evacuated enclosure of an x-ray tube. Disposed within the evacuated enclosure is a cathode and an anode, which is oriented to receive electrons emitted by the cathode. The anode can be stationary within the tube, or can be in the form of a rotating annular disk that is mounted to a rotor shaft and bearing assembly. The evacuated enclosure is typically contained within an outer housing, which can also serve as a coolant reservoir in some implementations.

In operation, an electric current is supplied to a filament portion of the cathode, which causes a cloud of electrons to be emitted via a process known as thermionic emission. A high voltage potential is then placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that at least some of the x-rays are emitted through x-ray transmissive windows defined in the evacuated enclosure and the outer housing. The emitted x-ray signal can then be used for a variety of purposes, including materials analysis and medical evaluation and treatment.

As mentioned, in order to produce x-rays, tubes require that a large voltage differential exists between the anode and the cathode. This voltage differential is provided in a number of ways, depending on the type of x-ray tube. In cathode-grounded tubes, for instance, the anode is maintained at a relatively high voltage potential, while the cathode is held at ground potential. In anode-grounded tubes the reverse is true, wherein the cathode is held at high potential and the anode is grounded. In double ended tubes, both the anode and the cathode are maintained at relatively high voltages: the anode at high positive potential and the cathode at high negative voltage potential.

In any of the above types of x-ray tubes, it is necessary to provide at least one high voltage connection to the tube in order to supply the requisite voltage potential(s) to the table components. For example, in cathode-grounded tubes a high voltage electrode is connected to the anode via a connection at the end of the evacuated enclosure nearest the anode (i.e., the anode end of the tube) to provide voltage potential to the anode. In anode-grounded tubes, the high voltage electrode is connected to the cathode via a connection at the cathode end of the evacuated enclosure to provide the cathode with the requisite voltage potential. In double ended tubes, both of these types of connections are present.

Because of the high voltages that are present in the tube, measures must be taken to electrically isolate the evacuated enclosure from the rest of the x-ray device, and from other components disposed near the device. For instance, in some applications the x-ray device is located within a CT scanner that is used to produce radiographic images of a patient's body. The x-ray tube must be electrically isolated from both the x-ray device in which it is located, as well as the CT scanner itself to prevent damage or injury from occurring to the device, scanner, patient, or technician. In addition to insuring safety, adequate levels of electrical isolation are also needed to insure proper operation by the x-ray tube.

Various methods have been devised to electrically insulate the x-ray tube within the x-ray device. One method involves placing the evacuated enclosure of the x-ray tube within a fluid-tight outer housing, and filling the housing with a dielectric oil, thereby submerging the tube within the oil and insulating it from the outer housing of the x-ray device. While effective at electrically isolating the tube, this method nonetheless suffers from several drawbacks. First, fitting the x-ray device with a fluid tight outer housing for containing the dielectric oil involves substantial time and expense. The outer housing must be manufactured with special seals and other components so as to enable it to provide fluid containment during tube operation. This increases both the cost and complexity of the x-ray device.

Second, the presence of dielectric oil within the outer housing makes tube repair or device changeout more difficult and time consuming. This in turn limits the ability to maintain tube performance by prompt and proper maintenance. Moreover, because of its caustic nature, dielectric oil can cause degradation of tube components that are in contact with it, thereby shortening the operational life of the x-ray device. Also, because of the large amounts of thermal energy that are created by the tube during operation, the dielectric oil can absorb significant amounts of heat during tube operation. Heated oil increases the risk of leakage from the outer housing that contains it. Not only can this damage adjacent components, but it can also represent a potential hazard to the x-ray device itself and to those who operate it.

Another method has alternatively been used to electrically isolate the tube from the rest of the x-ray device. In some x-ray tubes, a potting material is attached to portions of the tube surface in order to insulate it. Using this method, the tube is first placed within the device housing or a jig structure. Potting material is then attached piece by piece to the tube surface as needed to insulate it. As with the dielectric oil, this method can also insulate the tube from the rest of the x-ray device. However, this method also suffers from several drawbacks. First, the piece by piece application of the potting material to the tube is time consuming, and thus raises manufacturing costs. Second, defects in the potting material may be detected only after application of the potting material to the tube surface is complete and initial testing of the x-ray tube is begun. If a defect is found, the potting material must be stripped from the tube, the tube cleaned, and the process begun again. Again, this wastes both time and materials and prolongs the assembly process.

In light of the above discussion, a need exists in the art for a means by which portions of a high voltage device, such as an x-ray tube, can be electrically isolated from a high voltage signal. Any solution should preferably be accomplished in a manner that does not require the extensive manufacturing steps that are required by prior art approaches. Moreover, the solution should obviate the use of messy and problematic dielectric oils in insulating the x-ray tube. In addition, any solution should not require significant time or expense when repair or changeout of tube components is necessary. Finally, any solution should present a relatively trouble-free resolution to the above challenges so as to reduce problems associated with the x-ray device and to ensure operational longevity for the tube, especially for tubes operated in harsh, high stress environments where reliable operation is especially important.

SUMMARY OF EXEMPLARY EMBODIMENTS OF THE INVENTION

The present invention has been developed in response to the above and other needs in the art. Briefly summarized, embodiments of the present invention are directed to a dielectric connector that enables a high voltage signal to be supplied to the tube of an x-ray device. Specifically, a high voltage connector is disclosed that is easily implemented in x-ray tube manufacture and assembly. The present connector avoids problems associated with previous attempts to electrically insulate the tube from the rest of the x-ray device, such as applied potting material and dielectric oil-filled housings.

In one embodiment, the present connector comprises a pre-formed body that is shaped to fit over a corresponding portion of an x-ray tube evacuated enclosure that contains an anode, cathode, and other tube components. The body of the connector comprises a dielectric material that possesses sufficient electrical insulating characteristics so as to electrically insulate designated portions of the evacuated enclosure from other portions of the enclosure or x-ray device, such as an outer housing that encloses the evacuated enclosure. In an example embodiment, the dielectric material comprising the high voltage connector is pre-formed to a specified shape before it is attached to the surface of the tube's evacuated enclosure. This enables the connector to be tested and any defects in the dielectric material to be identified and corrected before the connector is attached to the tube.

In one embodiment, the high voltage connector is pre-formed to fit over a portion of the evacuated enclosure that houses the cathode. In another embodiment, the connector is shaped to fit over the enclosure portion enclosing the anode. In yet another embodiment, high voltage connectors can be joined to the evacuated enclosure over both the cathode and anode portions. In any of these embodiments, a receptacle cavity can be formed in the connector to enable a high voltage electrode to attach to a corresponding receptacle on the evacuated enclosure. The receptacle cavity can be integrally formed within the connector body, or can comprise a separate component that is attached to the connector.

Once it has been pre-formed and tested to ensure its integrity, the connector can be attached to the corresponding portion of the evacuated enclosure surface of the tube. This attachment can be facilitated through the use of a lubricant, such as grease or oil. Once attached to the tube, the high voltage electrode can be received into the receptacle cavity for connection with the tube receptacle. For example, in one embodiment the present connector can be configured to attach to the anode end of the evacuated enclosure. Once attached, a high voltage electrode is fit into the receptacle cavity of the connector and attached to a receptacle at the anode end of the evacuated enclosure. Via this electrode, a high voltage signal can be provided to the anode located within the evacuated enclosure during tube operation, thereby enabling the production of x-rays while other portions of the enclosure, such as the cathode end, are electrically insulated by the connector. A similar procedure is followed in another embodiment to attach both the connector and electrode to the cathode end of the tube while insulating the cathode end of the enclosure.

Because of its pre-formed nature, the present high voltage connector simplifies electrical isolation of the tube during manufacture of the x-ray device, resulting in a less complex and shorter tube assembly. Moreover, pre-forming the present high voltage connector enables possible defects therein to be identified and corrected before its attachment to the tube. The present connector simplifies tube assembly to the point that x-ray device components can be assembled on-site, enhancing overall ease of implementation. Moreover, when tube repair or component changeout is necessary, use of the high voltage connector simplifies such tasks.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Reference will now be made to figures wherein like structures will be provided with like reference designations.

It is understood that the drawings are diagrammatic and schematic representations of example embodiments, and are not limiting of the present invention nor are they necessarily drawn to scale.

FIGS. 1–6 depict various features of example embodiments, and are generally directed to a connector for use with high voltage devices. The connector embodiments are utilized to enable a high voltage electrode to be electrically connected to a portion of a device to provide a voltage signal for operation of the device. The connector further insulates portions of the high voltage device from the high voltage signal carried by the electrode. In illustrated embodiments, the connector is pre-formed before it is attached to the high voltage device, which in presently preferred embodiments comprises an x-ray tube. Pre-formation of the connector enables the dielectric material from which the connector is produced to be tested before attachment to the tube to ensure its suitability for use in the connector. After attachment to the tube, the connector provides the necessary insulative properties in electrically isolating the tube from other portions of the x-ray device. This in turn obviates the need for other insulating means, such as a dielectric oil-filled outer housing enveloping the tube. Thus the tube is insulated using simplified means, thereby reducing costs while enhancing manufacture, repair, and changeout options for the tube. It is appreciated that, while the description to follow focuses on use of the present connector with x-ray tubes, other high voltage devices can also benefit from application of the teachings herein.

Figure 1:
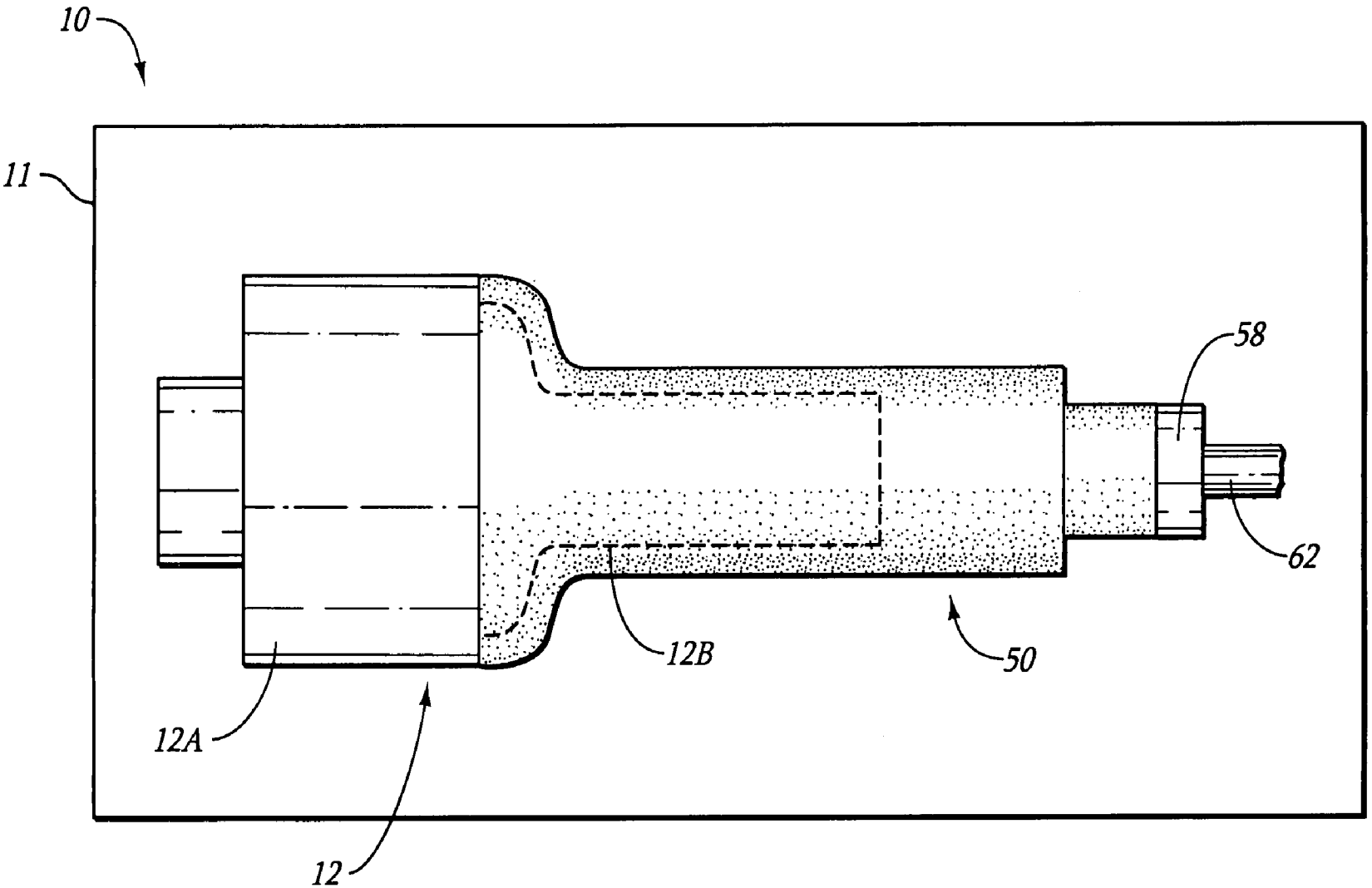
FIG. 1 is a simplified side view of an x-ray device including the dielectric connector according to one embodiment of the present invention.

Reference is first made to FIG. 1, which illustrates a simplified structure of a rotating anode-type x-ray tube, designated generally at 10. The x-ray tube 10 depicted here preferably comprises part of an x-ray generating device (not shown) for use in producing and emitting x-rays, as described above. The x-ray tube 10 includes an outer housing 11, within which is disposed an evacuated enclosure 12. The evacuated enclosure 12 is created by hermetically joining a first segment 12A with a second segment 12B, shown in phantom. The first segment 12A generally contains a cathode, while the second segment 12B contains an anode (not shown). The anode is spaced apart from and oppositely disposed to the cathode, and is at least partially composed of a thermally conductive material such as tungsten or a molybdenum alloy. The anode is rotatably supported by a rotor shaft and a bearing assembly (not shown).

As is typical, a high voltage potential is provided between the anode and cathode. By way of example, in the illustrated embodiment the anode is biased by a power source (not shown) to have a large positive voltage, while the cathode is maintained at ground potential. It will be appreciated that other voltage configurations could be provided. For example, in other embodiments, the cathode is biased with a negative voltage while the anode is grounded, or both the cathode and anode can be oppositely biased. A high voltage electrode, to be shown hereafter, is attached to a receptacle formed on the second segment 12B of the evacuated enclosure 12. The receptacle is electrically connected to the anode located within the evacuated enclosure 12. In this way, a high voltage signal provided by a power source (not shown) can be provided to the anode via the electrode and receptacle. While the x-ray tube 10 discussed here contains a rotating anode, it is appreciated that x-ray tubes having stationary anodes can also benefit from the disclosed high voltage connector.

The cathode includes at least one filament that is connected to an appropriate power source (not shown). During operation, an electrical current is passed through the filament to cause electrons to be emitted from the cathode by thermionic emission. Application of the high voltage differential between the anode and the cathode then causes the electrons to accelerate from the cathode filament toward a target surface on the rotating anode. As the electrons accelerate, they gain a substantial amount of kinetic energy, and upon striking the anode, some of this kinetic energy is converted into electromagnetic waves of very high frequency, i.e., x-rays. The emitted x-rays are directed through x-ray transmissive windows (not shown) disposed in the evacuated enclosure 12 and outer housing 11, respectively. The x-rays exiting the tube can then be directed for penetration into an object, such as a patient's body during a medical evaluation, or a sample for purposes of materials analysis.

In accordance with one presently preferred embodiment, the x-ray tube 10 further includes a connector, generally designated at 50, that is attached to the x-ray tube 10 as to substantially cover the second segment 12B of the evacuated enclosure 12. The connector 50 is generally responsible for facilitating the electrical connection of a high voltage electrode (see FIG. 3B) to a receptacle (see FIG. 3A) formed in the second segment 12B. The receptacle, in turn, is electrically connected to a portion of the anode disposed within the second segment 12B such that a high voltage signal can be passed from the electrode and receptacle directly to the anode during tube operation, thereby enabling the anode to participate in the production of x-rays, as described earlier.

In addition to facilitating the interconnection of the high voltage electrode with the receptacle of the second segment 12B, the connector 50 is also configured to electrically isolate portions of the evacuated enclosure 12 from the high voltages present at the electrode. This also enables the evacuated enclosure 12 to be electrically insulated from the outer housing 11, as is necessary for proper operation of the x-ray generating device. As such, the connector 50 is comprised of a dielectric material that possesses sufficient electrical insulative properties as to successfully perform the above function. Examples of such materials are given below.

As can be seen in the example embodiment of FIG. 1, the connector 50 is shaped as to substantially cover and conform to the surface of the second segment 12B of the evacuated enclosure 12, which is seen in phantom. This configuration is in accordance with the electrical insulation requirements of a cathode-grounded tube as that shown in FIG. 1, wherein the cathode end of the tube (i.e., first segment 12A) is held at ground potential, while the anode end of the tube (i.e., second segment 12B) is held at high positive potential. Thus, in this configuration, it is the second segment 12B of the evacuated enclosure that requires isolation, which isolation is provided by the connector 50 as shown in FIG. 1.

Figures 2A, 2B:
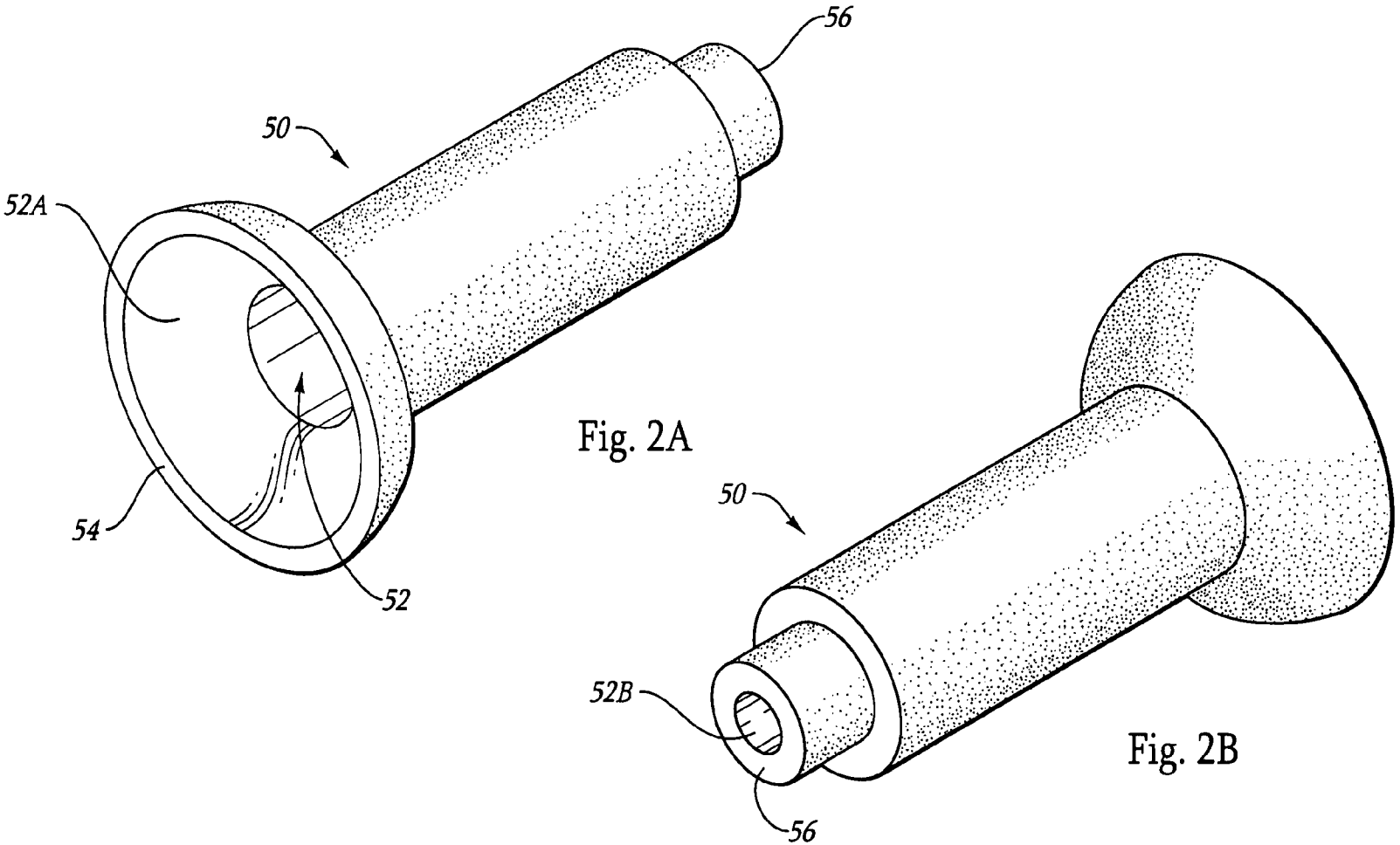
FIG. 2A is one perspective view of the present connector shown in FIG. 1.
FIG. 2B is another perspective view of the connector of FIG. 1.

Reference is now made to FIGS. 2A and 2B, which depict various perspective views of the connector 50 shown in FIG. 1, according to one embodiment thereof. As shown, the connector 50 is shaped to conform to a corresponding surface portion of the evacuated enclosure 12, in this case, the second segment 12B. Specifically, the connector 50 includes a cavity 52 extending from a first end 54 to a second end 56 of the connector. The cavity 52 is shaped to receive the corresponding second segment 12B therein. When joined, therefore, the inner surface of the cavity 52 is in physical engagement with the outer surface of the second segment 12B of the evacuated enclosure 12 in such a way as to provide electrical isolation of the second segment, as described above. As will be explained in greater detail below, the cavity opening at the first end 54 of the connector 50 receives the second segment 12B of the evacuated enclosure 12 when mating of the two is performed, while the cavity opening at the second end 56 of the connector facilitates receipt of a high voltage electrode (see FIG. 3B) for electrical connection with the anode.

As can be seen from FIGS. 2A and 2B, the connector 50 has a defined shape that conforms to the shape of the second segment 12B of the evacuated enclosure 12. Further, in accordance with embodiments of the present invention, the connector 50 is pre-formed to this shape before attachment with the evacuated enclosure 12. As such, the connector 50 in presently preferred embodiments is comprised of a material that possesses the desired dielectric characteristics while also possessing sufficient malleability, at least during the formation stage, to be pre-formed to the desired shape for attachment to the evacuated enclosure 12. In one embodiment, the connector 50 is composed of a silicone adhesive, product number 3-6642, produced by DOW CORNING®. The silicone adhesive 3-6642 is a two-part product that is mixed in the proper proportions prior to use and is flowable to allow pre-formation of the connector via casting, molding, machining, or other suitable technique. In addition, other materials can also be acceptably used to form the connector 50, such as epoxy/silicone mixtures, for example.

As mentioned, in present embodiments the material of which the connector 50 is composed, such as the silicone adhesive 3-6642 described above, possesses certain characteristics that optimize connector operation. First, the material is sufficiently malleable during manufacture to enable pre-formation of the connector, and can be resilient to assist in joining the connector to the evacuated enclosure. Additionally, the material is a dielectric to provide the necessary electrical isolation of the respective high voltage electrode utilized therewith. Also, as is the case with the silicone adhesive 3-6642, the material can be thermally conductive, if desired, to assist with heat removal from the evacuated enclosure 12 during tube operation.

In pre-forming the connector 50, a mold or other suitable surface can be used in conforming the shape of the connector 50 to that of the surface of the second segment 12B. After its formation, the pre-formed connector 50 can be tested to ensure that the dielectric material contains no defects that would prevent it from satisfactorily insulating the tube 10. If a defect is found, the connector 50 can be corrected and retested. Only after the connector 50 has been successfully tested will it be joined to a portion of the evacuated enclosure 12. The ability to pre-form and test the connector before attachment to a portion of the x-ray tube represents a significant advantage in the art, enabling corrections or modifications to the connector to be made during the pre-assembly stage, thereby saving both time and resources during tube assembly. Note that, while it is shown herein as configured to cooperatively fit with the second segment 12B of the evacuated enclosure (as shown in FIG. 3B), the present connector can be pre-formed to fit with other portions of the evacuated enclosure (as will be shown), or with other portions of a high voltage device, as appreciated by those of skill in the art.

Figure 3A:
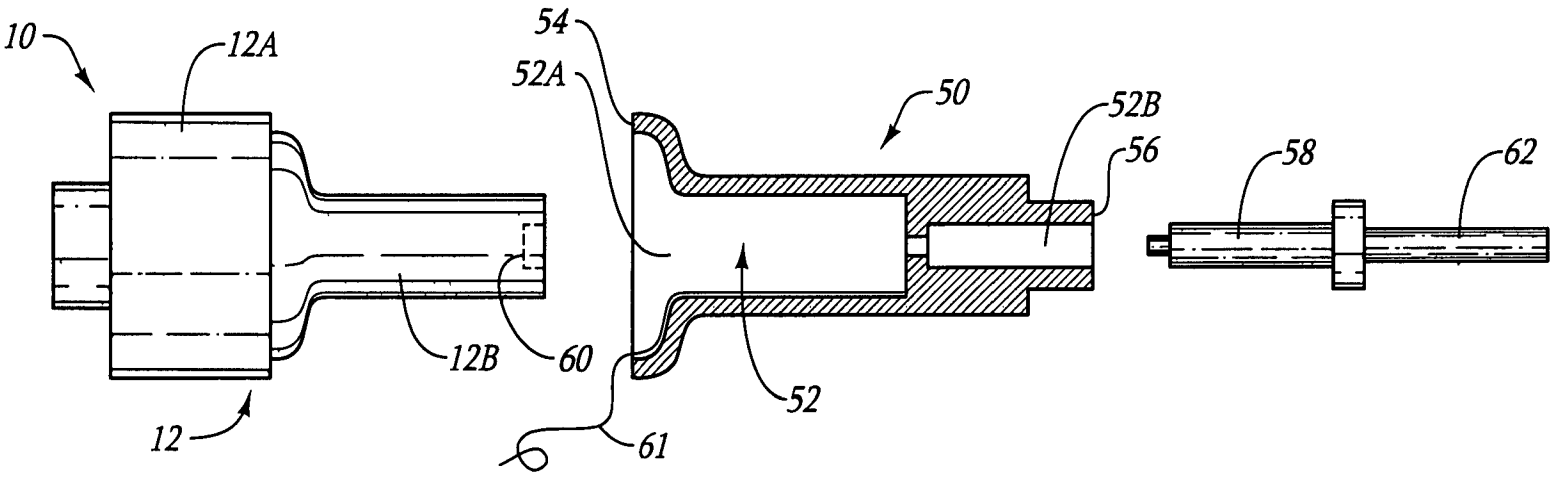
FIG. 3A is a side view of an x-ray tube and cross sectional view of the present connector before mutual attachment.
Figure 3B:
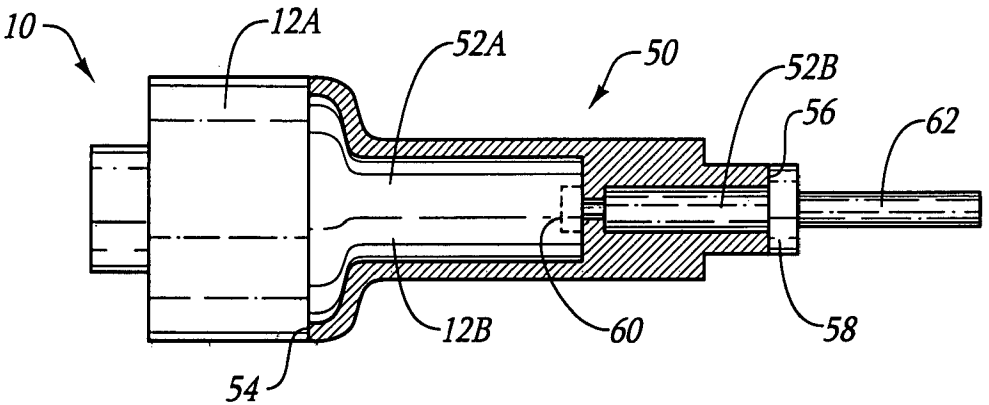
FIG. 3B is a side/cross sectional view of the x-ray tube and connector of FIG. 3A after attachment of the connector to the tube.

Reference is now made to FIGS. 3A and 3B. These figures show the x-ray tube 10 both before and after joining of the present connector 50 thereto. In FIG. 3A, the connector 50 is shown in cross section to depict the cavity 52, which has an opening at both the connector first end 54 and second end 56. FIG. 3A further shows that the cavity 52 comprises a main cavity portion 52A for receiving the second segment 12B of the evacuated enclosure 12, and a receptacle cavity portion 52B, which is sized and configured to receive a high voltage electrode 58. The receptacle cavity 52B is aligned to enable the high voltage electrode 58 to electrically connect with a receptacle 60 located at the surface of the evacuated enclosure 12. Though FIGS. 3A and 3B show the main cavity portion 52A being in direct communication with the receptacle cavity 52B, in other embodiments these cavities are not in direct communication, but are separate from one another.

In FIG. 3B, the connector 50 is shown matingly attached to the second segment 12B of the evacuated enclosure 12. The mating between the connector 50 and the second segment 12B is accomplished such that the inner surface of the main cavity portion 52A physically contacts the outer surface of the second segment 12B. This ensures adequate electrical isolation of the second segment 12B. Preferably, a substantial portion of the connector 50 achieves physical contact with a substantial portion of the second segment 12B, as shown in FIG. 3B. Less substantial partial contact between the two surfaces can also be acceptable, depending upon the needs of the particular configuration. If needed, a suitable adhesive or other fastening means can be employed to secure the attachment of the connector 50 to the second segment 12B.

The attachment of the connector 50 (or other connector discussed herein) to the evacuated enclosure 12 can be assisted through the use of a bleeding device, such as a bleeding line 61 (shown in FIG. 3A), or other appropriate means, in cases where air entrapment within the connector cavity 52 is to be prevented. Air entrapment within the connector cavity 52 is to be overcome primarily in those embodiments where the main cavity portion 52A is not in physical communication with the receptacle cavity portion 52B. In FIG. 3A, the bleeding line 61 is a flexible wire that is placed within the main cavity portion 52A before mating of the connector 50 to the evacuated enclosure 12 is begun. As the evacuated enclosure 12 is received into the main cavity portion 52A of the connector 50, the bleeding line 61 is maintained in place and is sandwiched between the connector and evacuated enclosure mating surfaces. The bleeding line 61 is configured such that it creates an air path between the connector cavity interior and the connector exterior, thereby allowing air to bleed from the main cavity portion 52A during mating. For instance, the bleeding line 61 can have a hollow cylindrical structure. Or, the bleeding line 61 can have a solid wire-like configuration. In this latter case, the sandwiching of the bleeding line 61 between the mating surfaces of the connector 50 and evacuated enclosure portion 12B creates a temporary void about the bleeding line, which creates the necessary air path from the connector cavity to the connector exterior. So configured, the bleeding line 61 ensures air pressure equivalence between the connector interior and exterior as to ease joining of the respective components. Once the evacuated enclosure portion 12B is fully received into the main cavity portion 52A of the connector 50, the bleeding line 61 can be removed and the void, if any, can be eliminated.

In other embodiments, alternative means can be employed to accomplish the same bleeding functionality described above, such as bleeding holes defined through the connector body in such a way as not to interfere with nearby electric fields. Such a bleeding device can be used with any of the embodiments described herein.

The joining of the connector 50 to the second segment 12B can be further assisted through the use of a lubricant, such as dielectric grease or oil. The lubricant can be spread on the joining surfaces of either the connector cavity 52 or the second segment, or both. Use of the lubricant eases the engagement between the two components during tube assembly. The lubricant can also compensate for uneven surface features and voids on the joining surfaces by filling such areas, thereby ensuring an adequate fit between the connector 50 and the second segment 12B.

As shown in FIG. 3B, the mating of the connector 50 with the second segment 12B is such that the first end 54 of the connector abuts an adjacent end of the first segment 12A of the evacuated enclosure 12. The opening of the receptacle cavity 52B at the second end 56 of the connector 50 is shown with the high voltage electrode 58 received therein such that it electrically connects with the receptacle 60 of the second segment 12B. The receptacle 60 is electrically connected to the anode (not shown) within the evacuated enclosure 12. The electrode 58 is connected to a high voltage cable 62 that provides the voltage signal. In this way, the anode disposed within the second segment 12B is provided with a high voltage signal. In other embodiments, the electrical connection between the receptacle 60 and the high voltage electrode 58 is not a direct connection as described above, but rather an indirect connection where additional conductive features are included to establish the connection. An example of this is shown in the embodiment illustrated in FIGS. 7A and 7B.

The portion of the connector 50 defining the receptacle cavity 52B is shown in FIGS. 3A and 3B to be integrally formed with the portion of the connector defining the main cavity 52A. However, in one alternative embodiment, these connector portions can be made separately, then joined together before mating of the connector to the tube, if desired. In another alternative embodiment, the electrode 58 can be directly molded into the body of the connector 50 at the appropriate position during the formation phase of the connector. Assuming the tube 10 shown in FIG. 3B is properly assembled and contained within an x-ray generating device, it is now ready for operation in producing x-rays, as described further above.

Figure 4B:
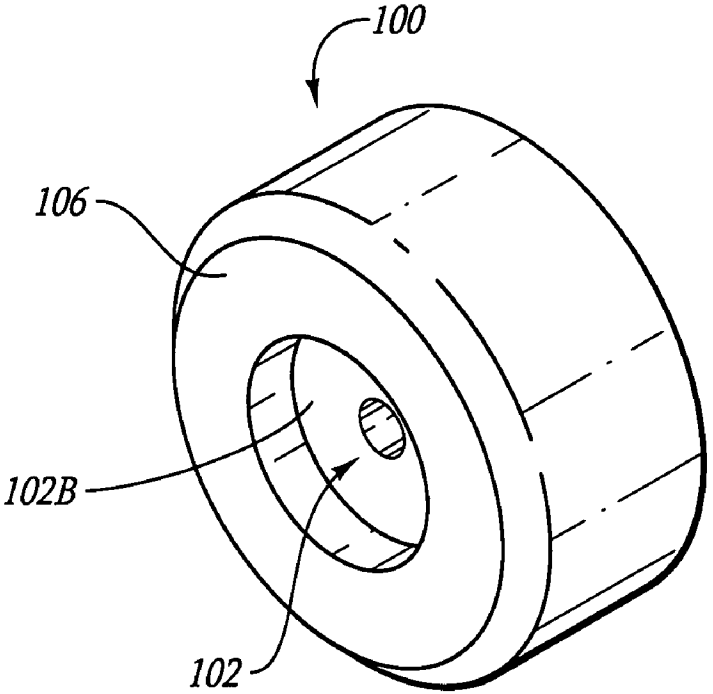
FIG. 4B is another perspective view of the connector of FIG. 4B.
Figure 4A:
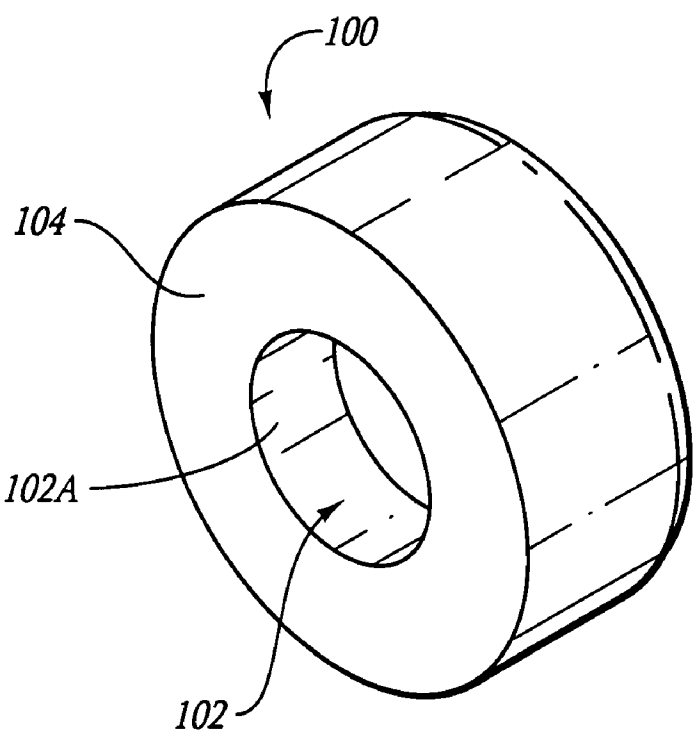
FIG. 4A is one perspective view of a dielectric connector according to another embodiment of the present invention.

Reference is now made to FIGS. 4A and 4B, which together show various perspective views of a high voltage connector according to another embodiment of the present invention. The high voltage connector shown in FIGS. 4A and 4B is generally designated at 100, and is configured for use with an x-ray tube, such as the tube 10 shown in FIG. 1. Though it differs from the connector 50 discussed in connection with the previous embodiment, the connector 100 shown in FIGS. 4A and 4B also shares some similar characteristics. To the extent that similar features exist between the two connectors, some of these features will not be explicitly discussed herein.

The connector 100, like the connector of the previous embodiment, is configured to enable the connection of a high voltage electrode to the x-ray tube 10 while electrically insulating a portion of the tube, such as a portion of the evacuated enclosure 12. In contrast to the previous embodiment, however, the connector 100 is sized and configured for engagement with the first segment 12A of the evacuated enclosure. This configuration can be used, for example, in anode-grounded x-ray tubes. In an anode-grounded tube the cathode is biased with a high negative voltage potential while the anode is maintained at ground potential. It will be appreciated that the present connector can be utilized in other types of tubes and high voltage devices as well. As seen in FIGS. 4A and 4B, the connector 100 is shaped to define a cavity 102 extending from a first end 104 to a second end 106. The cavity 102 comprises a main cavity portion 102A having an opening at the first end 104 for receiving a portion of the first segment 12A of the evacuated enclosure 12, and a receptacle cavity portion 102B having an opening at the second end 106 for receiving a high voltage electrode (see FIG. 5).

The connector 100 is pre-formed to its intended shape before attachment to a portion of the x-ray tube 10. Again, this enables the connector 100 to be tested and to verify that it is ready for attachment to the x-ray tube 10. If any defect is found in the connector 100 after re-formation thereof is complete, the defect can be easily corrected without requiring its removal from the tube surface, thereby saving cost and time, as well as reducing waste. The material and process of formation for the connector 100 is similar to that of the connector 50 described above.

Figure 5:
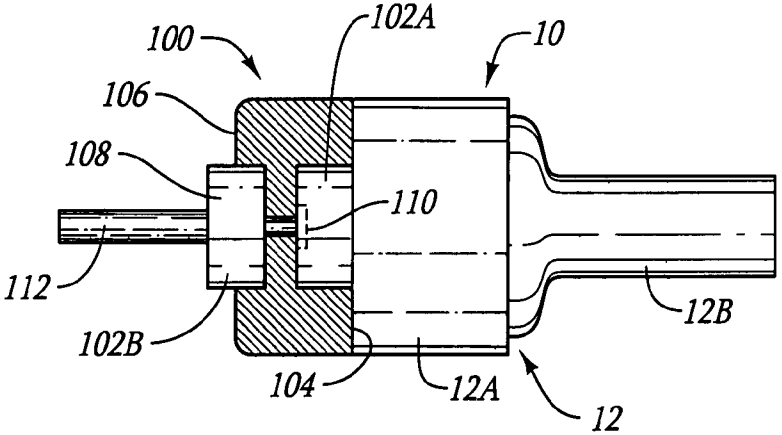
FIG. 5 is side/cross sectional view of an x-ray tube having attached thereto the dielectric connector of FIGS. 4A and 4B.

Reference is now made to FIG. 5, which shows the connector 100 as attached to the x-ray tube 100, in accordance with the present embodiment. In particular, a portion of the first segment 12A is received into the main cavity 102A such that the first end 104 of the connector 100 abuts another portion of the first segment. A high voltage electrode 108 is shown received within the receptacle cavity 102B. The receptacle cavity 102B is aligned with a receptacle 110 disposed at the surface of the first segment 12A such that the electrode 108 physically and electrically connects thereto when received into the receptacle cavity 102B of the connector 100. The receptacle 110 in turn is electrically connected to the cathode (not shown) located within the first segment 12A of the evacuated enclosure 12. As before, a high voltage cable 112 is attached to the electrode 108 to provide the desired voltage potential to the cathode within the first segment 12A during operation of the x-ray tube, thereby enabling the cathode to participate in the production of x-rays. As a result of the placement of the connector 100 on the evacuated enclosure 12 as shown in FIG. 5, the first segment 12A is sufficiently electrically isolated, thereby preventing any high voltage from escaping to the outer housing 11 or other portion of the x-ray generating device.

In one embodiment, the connector 100 can be configured to extend over a larger portion of the first segment 12A of the evacuated enclosure 12 than what is shown in FIG. 5. Indeed, if desired the connector 100 can be resized and configured to extend over the entire surface of the first segment 12A. If so, an aperture can be defined in a portion of the connector 100 corresponding to the location of the x-ray transmissive window (not shown) located at the surface of the evacuated enclosure 12 such that the connector does not obstruct the passage of x-rays when attached to the enclosure.

Figure 6:
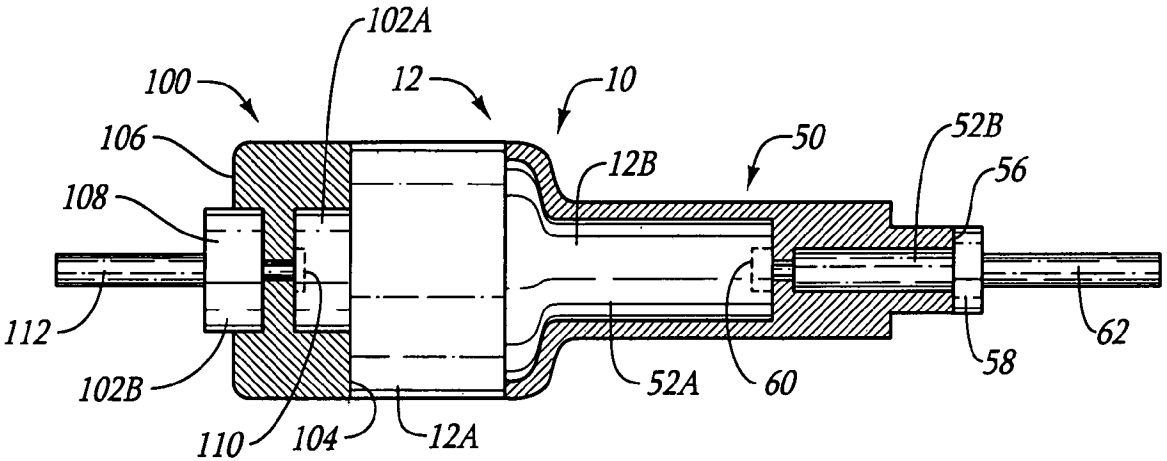
FIG. 6 is side/cross sectional view of an x-ray tube having attached thereto two dielectric connectors in accordance with yet another embodiment of the present invention.

Reference is now made to FIG. 6. As shown, principles of both embodiments described above can be combined to electrically isolate multiple portions of the x-ray tube 10 simultaneously. In particular, FIG. 6 shows a first connector 50 attached to a second segment 12B of an evacuated enclosure of the x-ray tube 10, and a second connector 100 attached to a first segment 12A of the evacuated enclosure. The first and second connectors 50 and 100 are configured in a manner similar to those of the connectors 50 and 100, respectively, that are described above. Use of the first and second connectors 50 and 100 enables electrical isolation of both anode and cathode-related portions of the x-ray tube 10 to be achieved. The arrangement depicted in FIG. 6 is one that is useful with double-ended x-ray tubes that bias both the cathode and the anode with relatively differing high voltages.

Figure 7A:
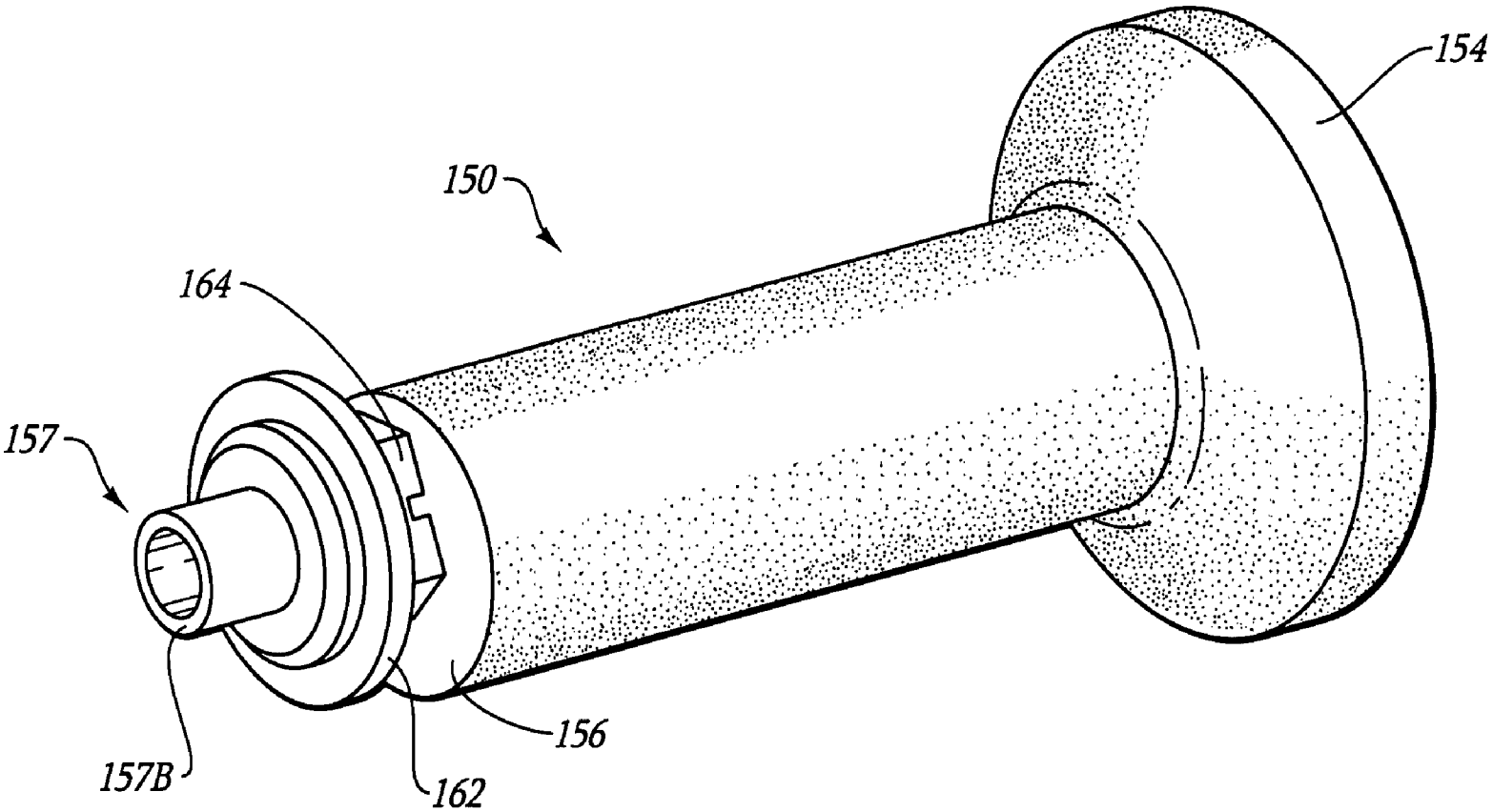
FIG. 7A is a perspective view a dielectric connector according to yet another embodiment.
Figure 7B:
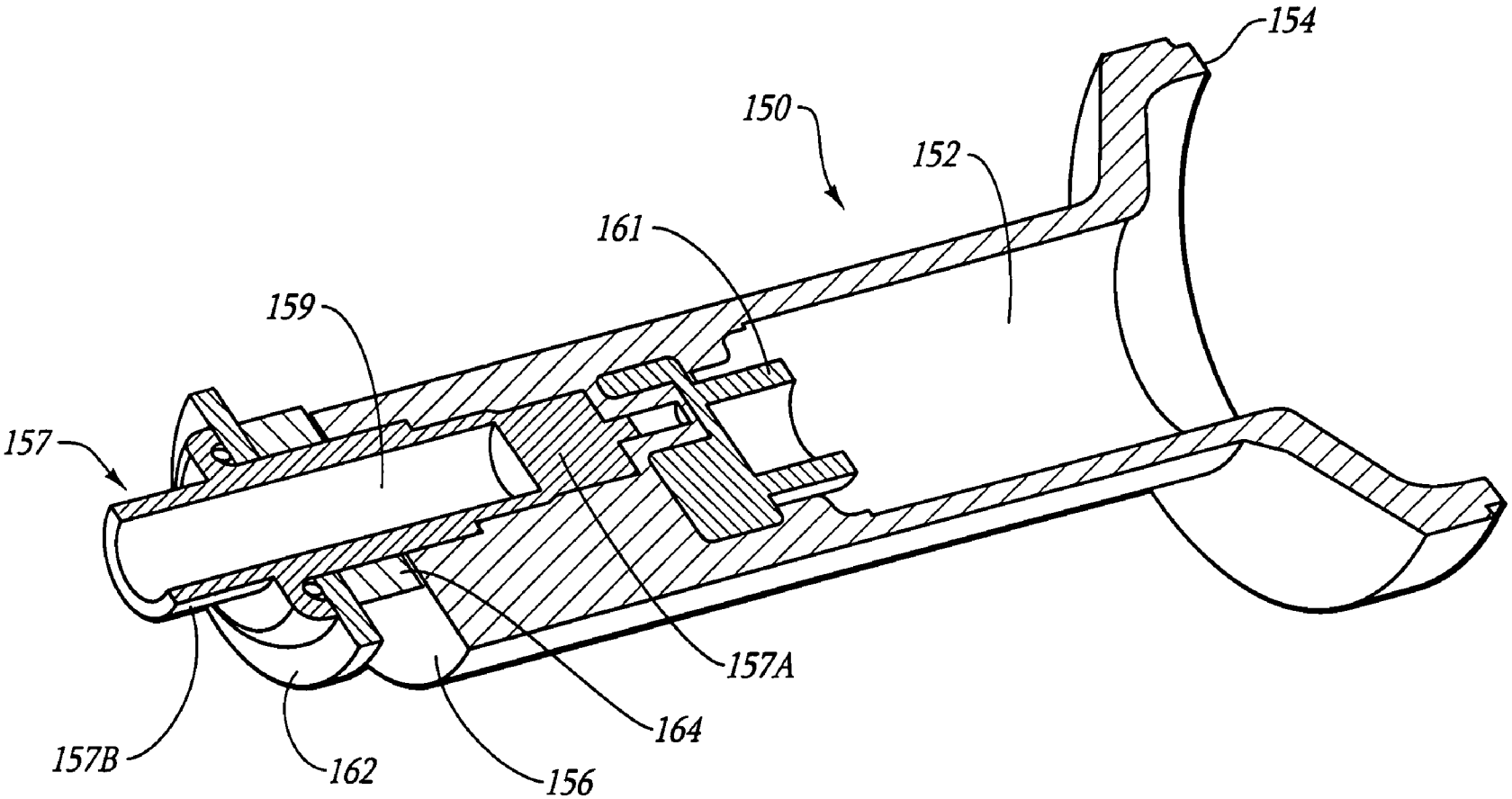
FIG. 7B is a cross sectional view of the dielectric connector of FIG. 7A taken along the lines 7B—7B.

Reference is now made to FIGS. 7A and 7B, which show various features of yet another embodiment. A connector 150 is shown, configured for use in electrically isolating an anode-related second segment of an evacuated enclosure, such as the evacuated enclosure second segment 12B shown in FIG. 1. In detail, the connector 150 includes a cavity 152 having an open first end 154 for receiving a portion of an evacuated enclosure and a second end 156. A receptacle sleeve 157 is shown incorporated with the connector 150 such that a first portion 157A of the receptacle sleeve is enveloped by the connector and a second portion 157B extends from the connector second end 156. A washer 162 and nut 164 are also included to assist with the mounting and operation of the receptacle sleeve.

In accordance with the present embodiment, the receptacle sleeve 157 is molded into the connector 150 during manufacture so as to be permanently joined thereto. The receptacle sleeve 157 includes a cavity 159 that is sized to receive a high voltage electrode (not shown) therein. The receptacle sleeve 157 is electrically connected to a conductive mount 161 that is also molded into the connector 150 so as to extend into the connector cavity 152. The conductive mount 161 in turn is electrically connected to an anode positioned within the evacuated enclosure (not shown). This electrical scheme serves as one example of an indirect connection path through the connector that enables the anode to be supplied with a high voltage signal when the high voltage electrode is received into the receptacle sleeve 157. Other electrical connection schemes can alternatively be configured, according to design needs.

The above discussion illustrates one feature of embodiments of the present invention, wherein various components can be integrally molded into the connector. As a further example, in one embodiment the high voltage electrode, such as that shown at 58 in FIGS. 3A and 3B, can be molded directly into the connector so as to be permanently joined thereto. This configuration obviates the need for the receptacle sleeve of the previous embodiment.

In yet another embodiment, heat dissipating elements can be included in the connector. For instance, in FIGS. 7A and 7B, the conductive mount 161 is molded into the connector 150 and is configured to dissipate heat from the evacuated enclosure during tube operation. To assist in this purpose, the conductive mount 161 is formed from a thermally conductive material, such as copper, brass, aluminum, etc. In addition, a mixture, such as boron nitride powder, can be interposed between the conductive mount 161 and the portion of the evacuated enclosure (not shown) received by the conductive mount in order to enhance heat transfer from the evacuated enclosure. In one embodiment, the boron nitride powder can be mixed with a grease composition to enhance the thermal path between the components. In other embodiments, alternative heat dissipating devices can be incorporated with the connector to enhance heat removal.

The high voltage connectors described herein can be used to streamline diagnostic testing of an x-ray tube during its manufacturing phase. Because of the dielectric qualities of the connector(s), an x-ray tube can be electrically connected to one or both electrodes, positioned, and tested under operational conditions. No further electrical isolation is required. This eliminates the need for other, less efficient diagnostic testing configurations, such as the submerging of each x-ray tube in oil-filled containers that are used to electrically isolate the tubes prior to testing.

In some embodiments, the connectors disclosed above can include shielding materials to enhance x-ray absorption within the x-ray tube, which in turn reduces unintended x-ray emission. In accordance with this aim, an x-ray absorbing material can be incorporated into the connector design in order to enable it to absorb x-rays, thereby preventing their escape from the outer housing (FIG. 1). For instance, in one embodiment the connector includes a two-part design, wherein a first portion, composed of DOW CORNING® silicone adhesive 3-6642 or other suitable material, is formed to the shape of the connectors as described above (see, e.g., connectors 50 and 100 in FIG. 6). A second covering portion can then be added to cover exterior surfaces of the first portion. The second covering portion can be composed of a mixture of silicone adhesive 3-6642 (or other suitable material) and an x-ray absorptive material, as has been discussed. This implementation provides an x-ray shielding function while not interfering with the dielectric isolation function of the connector. The x-ray absorptive material can include a powder composed of one or more of a variety of x-ray opaque materials, including molybdenum, tungsten, lead, and other appropriate high-Z materials.

In addition to x-ray absorbing powders, the connector can incorporate other x-ray absorbing structures in order to shield x-rays. One example is x-ray opaque plating that can be applied to exterior or outer surfaces of the connector or incorporated within the connector in a manner that does not interfere with the dielectric qualities of the connector. These are just two examples of x-ray shielding that can be incorporated into the connector of the present invention. Other shielding structures and methods are also contemplated by the present invention.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A connector for use in electrically insulating a portion of a high voltage device, the connector comprising a dielectric material that is pre-formed to define a main cavity, the main cavity formed to receive a corresponding surface of an evacuated enclosure of the high voltage device, the pre-formed dielectric material further defining a receptacle cavity through which an electrode can electrically connect to the high voltage device.

2. A connector as defined in claim 1, wherein the main cavity receives the corresponding surface of the evacuated enclosure of the high voltage device such that the surface is electrically insulated from the electrode.

3. A connector as defined in claim 2, wherein the receptacle cavity of the connector is in physical communication with the main cavity.

4. A connector as defined in claim 2, further comprising a bleeding hole extending from an outer surface of the pre-formed dielectric material to the main cavity.

5. A connector as defined in claim 1, wherein the dielectric material is composed of a silicone adhesive.

6. A connector as defined in claim 1, wherein the high voltage device comprises an x-ray tube.

7. An x-ray tube, comprising:

an evacuated enclosure containing a cathode with an electron source that is capable of producing electrons and an anode having a target surface that is positioned to receive the electrons produced by the electron source;

a high voltage electrode configured to electrically connect with a cathode receptacle positioned on the surface of the evacuated enclosure, the receptacle being configured to provide a high voltage potential to the cathode; and a connector configured to enable the high voltage electrode to electrically connect with the cathode receptacle, the connector being preformed from a dielectric material before attachment to the evacuated enclosure to include a cavity that is sized to receive a specified portion of the evacuated enclosure that is proximate the cathode receptacle.

8. An x-ray tube as defined in claim 7, wherein the cavity further comprises a main cavity portion that receives the specified portion of the evacuated enclosure and a receptacle cavity portion that receives the electrode when the connector is attached to the evacuated enclosure.

9. An x-ray tube as defined in claim 8, wherein the connector is attached to the evacuated enclosure such that the receptacle cavity portion is aligned with the cathode receptacle, and wherein the electrode is received within the receptacle cavity portion when the electrode is attached to the cathode receptacle.

10. An x-ray tube as defined in claim 8, wherein the receptacle cavity portion is integrally formed with the connector.

11. An x-ray tube as defined in claim 8, wherein the portion of the connector defining the receptacle cavity portion is pre-formed and attached to a pre-formed portion of the connector defining the main cavity portion.

12. An x-ray tube as defined in claim 7, wherein the evacuated enclosure comprises first and second segments that are hermetically joined to form the evacuated enclosure, the cathode receptacle being disposed on the first segment that substantially contains the cathode.

13. An x-ray tube as defined in claim 12, wherein the connector is physically affixed to the evacuated enclosure.

14. An x-ray tube as defined in claim 7, wherein a lubricant is used to assist the attachment of the connector to the evacuated enclosure.

15. An x-ray tube as defined in claim 7, further comprising a second connector configured to enable a second electrode to electrically connect with an anode receptacle located on the evacuated enclosure, the second connector being preformed from a dielectric material before attachment to the evacuated enclosure to include a cavity that is sized to receive a specified portion of the evacuated enclosure that is proximate the anode receptacle.

16. An x-ray tube as defined in claim 15, wherein the second connector includes an x-ray absorptive component.

17. An x-ray tube as defined in claim 7, wherein the connector includes an x-ray absorptive component.

18. An x-ray tube, comprising:

an evacuated enclosure containing a cathode with an electron source that is capable of producing electrons and an anode having a target surface that is positioned to receive the electrons produced by the electron source;

a high voltage electrode configured to electrically connect with an anode receptacle positioned on the surface of the evacuated enclosure, the anode receptacle being configured to provide a high voltage potential to the anode; and a connector configured to enable the high voltage electrode to electrically connect with the anode receptacle, the connector being pre-formed from a dielectric material before attachment to the evacuated enclosure to include a cavity that is sized to receive a specified portion of the evacuated enclosure that is proximate the anode receptacle.

19. An x-ray tube as defined in claim 18, wherein the cavity further comprises a main cavity portion that receives the specified portion of the evacuated enclosure and a receptacle cavity portion that receives the electrode when the connector is attached to the evacuated enclosure.

20. An x-ray tube as defined in claim 19, wherein the connector is attached to the evacuated enclosure such that the receptacle cavity portion is aligned with the anode receptacle, and wherein the electrode is received within the receptacle cavity portion when the electrode is attached to the anode receptacle.

21. An x-ray tube as defined in claim 19, wherein the receptacle cavity portion is integrally formed with the connector.

22. An x-ray tube as defined in claim 19, wherein the portion of the connector defining the receptacle cavity portion is pre-formed and attached to a pre-formed portion of the connector defining the main cavity portion.

23. An x-ray tube as defined in claim 18, wherein the evacuated enclosure comprises first and second segments that are hermetically joined to form the evacuated enclosure, the anode receptacle being disposed on the second segment that substantially contains at least a portion of the anode.

24. An x-ray tube as defined in claim 23, wherein the connector is physically affixed to the evacuated enclosure.

25. An x-ray tube as defined in claim 24, wherein a lubricant is used to assist the attachment of the connector to the evacuated enclosure.

26. An x-ray tube as defined in claim 25, further comprising a second connector configured to enable a second electrode to electrically connect with a second receptacle located on the evacuated enclosure, the second connector being pre-formed from a dielectric material before attachment to the evacuated enclosure to include a cavity that is sized to receive a specified portion of the evacuated enclosure that is proximate the second receptacle.

27. An x-ray tube as defined in claim 18, wherein at least a portion of the high voltage electrode is permanently incorporated within the connector during formation of the connector.

28. A method of attaching a high voltage supply to an x-ray tube, the x-ray tube including an evacuated enclosure containing a cathode and an anode, the method comprising:

pre-forming a dielectric material into a connector, the connector defining a cavity comprising a receptacle cavity and a main cavity, the main cavity being sized to receive a corresponding portion of the surface of the evacuated enclosure on which a receptacle is defined;

joining the connector to the corresponding portion of the surface of the evacuated enclosure such that the receptacle cavity aligns with the receptacle; and attaching a high voltage electrode to the receptacle of the evacuated enclosure, the electrode being at least partially disposed within the receptacle cavity of the connector.

29. A method of attaching as defined in claim 28, wherein the receptacle is electrically connected to the cathode.

30. A method of attaching as defined in claim 28, wherein the receptacle is electrically connected to the anode.

31. A method of attaching as defined in claim 28, further comprising:

before joining the connector to the corresponding portion of the surface of the evacuated enclosure, applying a lubricant to at least one of the main cavity and the surface of the evacuated enclosure.

32. A method of attaching as defined in claim 28, wherein the main cavity and receptacle cavity are in physical communication with one another.

33. A method of attaching as defined in claim 28, wherein joining the connector further comprises:

utilizing a bleeding device to allow the escape of air from the receptacle cavity.

34. A connector assembly for use with an x-ray tube, comprising:

a connector that is pre-formed from a dielectric material, the connector including a cavity that receives a corresponding portion of an evacuated enclosure of the x-ray tube; and a receptacle sleeve that is permanently received by the connector, the receptacle sleeve being configured to receive a high voltage electrode that electrically connects with the x-ray tube.

35. A connector assembly as defined in claim 34, wherein at least a portion of the receptacle sleeve is incorporated within the connector during formation of the connector.

36. A connector assembly as defined in claim 35, further comprising a heat dissipating element that is operably connected to the connector to remove heat from the x-ray tube.

37. A connector assembly as defined in claim 36, wherein the heat dissipating element includes a conductive mount that is permanently connected to the connector as to extend into the cavity.

38. A connector assembly as defined in claim 37, above, wherein the conductive mount includes boron nitride to enhance heat dissipation characteristics of the conductive mount.

39. A connector assembly as defined in claim 34, wherein the high voltage electrode does not physically connect with the evacuated enclosure.

* * * * *

UNITED STATES PATENT AND TRADEMARK OFFICE

CERTIFICATE OF CORRECTION

PATENT NO. : 7,142,639 B2
APPLICATION NO. : 10/827153
DATED : November 28, 2006
INVENTOR(S) : Smith et al.

It is certified that error appears in the above-identified patent and that said Letters Patent is hereby corrected as shown below:

Column 1
Line 63, change "table" to --tube--

Column 10
Line 8, change "re-formation" to --pre-formation--

Signed and Sealed this

Twenty-third Day of November, 2010

David J. Kappos

David J. Kappos
*Director of the United States Patent and Trademark Office*